US005135112A

United States Patent [19]

Kamen et al.

[11] Patent Number: 5,135,112

[45] Date of Patent: Aug. 4, 1992

[54] COSMETIC COMPACT CASE WITH TELESCOPIC COVER AND REMOVABLE APPLICATOR

[76] Inventors: Melvin Kamen, 160 Portland Rd., Highlands, N.J. 07732; Philip Bernstein, 16 Stonehouse Rd., Glen Ridge, N.J. 07028

[21] Appl. No.: 548,692

[22] Filed: Jul. 5, 1990

[51] Int. Cl.[5] ..... B65D 69/00

[52] U.S. Cl. ..... 206/581; 132/294; 132/297; 132/317; 401/126; 401/127

[58] Field of Search ..... 206/229, 581; 132/294, 132/297, 317, 318; 401/123, 124, 126, 127, 128, 129

[56] References Cited

U.S. PATENT DOCUMENTS

| | | | |
|---|---|---|---|
| 793,327 | 6/1905 | Swoyer et al. | 401/125 |
| 1,682,534 | 8/1928 | Martinat . | |
| 1,712,496 | 5/1929 | Goertz | 401/125 |
| 2,281,532 | 4/1942 | Lewis et al. | 401/125 |
| 2,375,027 | 5/1945 | Naidech | 132/317 |
| 2,521,269 | 9/1950 | Turnes | 401/124 |
| 2,943,344 | 7/1960 | Reed | 401/125 |
| 2,951,489 | 9/1960 | Roberts | 401/125 |
| 3,132,653 | 5/1964 | Gazdik | 401/129 |
| 3,317,078 | 5/1967 | Gordon . | |
| 3,363,635 | 1/1968 | Wurmbock | 401/128 |
| 3,397,707 | 8/1968 | Aversa | 132/317 |
| 3,559,854 | 2/1971 | Loveland | 132/294 |
| 3,760,820 | 9/1973 | Seidler | 206/229 |
| 4,569,438 | 2/1986 | Sheffler . | |
| 4,679,692 | 7/1987 | Davey | 206/581 |
| 4,684,017 | 8/1987 | Watanabe et al. . | |

FOREIGN PATENT DOCUMENTS

| | | | |
|---|---|---|---|
| 338377 | 3/1936 | Italy | 138/84 |
| 685054 | 12/1952 | United Kingdom | 401/129 |

*Primary Examiner*—David T. Fidei

[57] ABSTRACT

A cosmetic compact case includes an elongated body which is provided with a plurality of cosmetic-containing receptacles on an exterior surface thereof. Access to the cosmetic material contained in the receptacles is controlled by a cover which is slideably mounted on the body of the compact case.

11 Claims, 2 Drawing Sheets

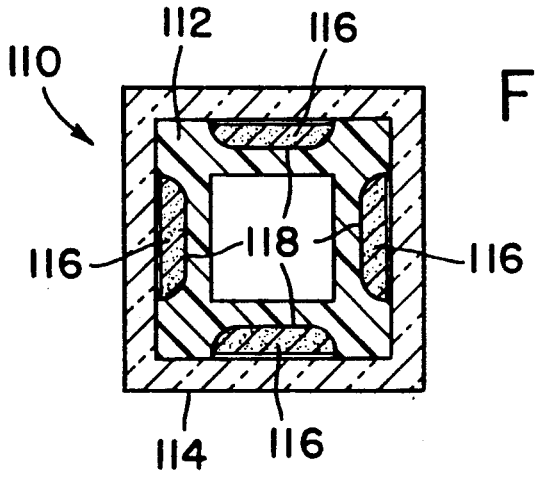
FIG. 4
FIG. 5
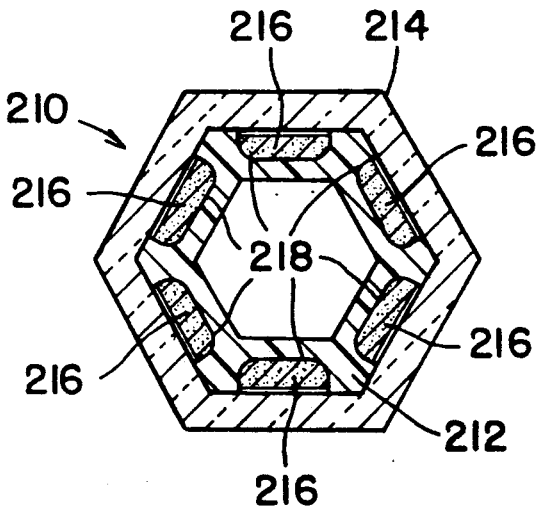
FIG. 6
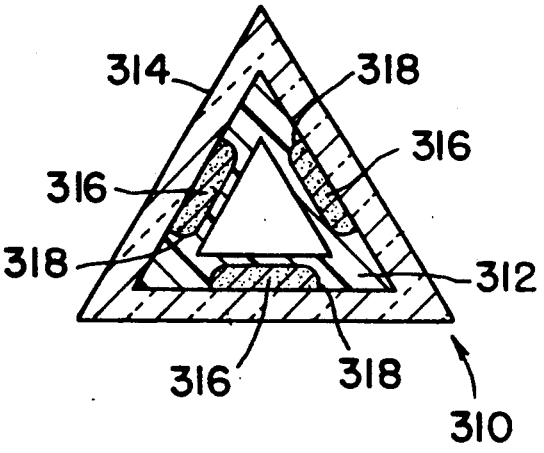
FIG. 7
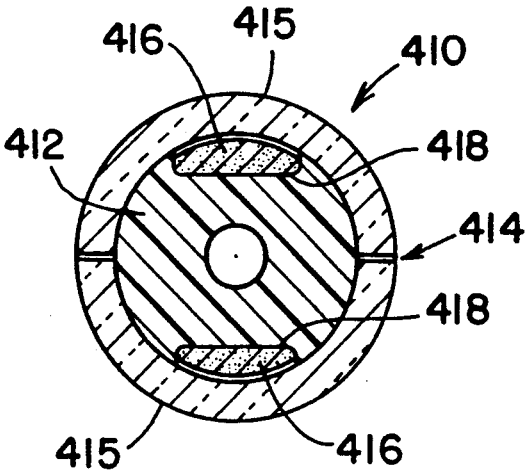

COSMETIC COMPACT CASE WITH TELESCOPIC COVER AND REMOVABLE APPLICATOR

FIELD OF THE INVENTION

The present invention relates to cosmetic containers, and, more particularly, to cosmetic compact cases adapted to carry solid or semi-solid cosmetics, such as eye shadow paste or compressed powder blush.

BACKGROUND OF THE INVENTION

Compact cases and the like have been in existence for many years. Traditionally, such cases have employed a lid or cover which is pivotally attached by a hinge or an equivalent mechanical mechanism to a base or body of the case in such a manner that the lid can be pivoted relative to the base between a closed position and an open position. The use of a hinge is disadvantageous because it complicates the manufacture and/or assembly of the compact case. Moreover, due to the complexity of molding a hinge, especially if it is miniaturized, high stresses can develop in the plastic, creating the possibility that the body of the hinge might fracture. Such stresses also make the plastic susceptible to chemical attack and swelling, which, if severe enough, could render the hinge inoperable due to jamming.

Typically, the lids of existing compact cases, whether of a hinged variety or a non-hinged variety, are releasably retained in their closed position by a clasp, a catch or an equivalent mechanical mechanism (see, for instance, U.S. Pat. Nos. 1,682,534; 4,569,438 and 4,684,017). Magnets have also been employed in place of the more conventional clasps and catches (see, for instance, U.S. Pat. No. 3,317,078). The use of such clasps, catches and magnets further complicates the manufacture and assembly of their associated compact cases.

SUMMARY OF THE INVENTION

The problems and disadvantages associated with the prior art devices discussed above are overcome in accordance with the present invention by providing a compact case with a telescopic cover mounted for sliding movement relative to a core or body of the compact case, thereby eliminating the need to equip the compact case with hinges or the like. More particularly, the core has an exterior surface which is provided with at least one receptacle adapted to receive cosmetic material. The cover can be slid between a closed position, in which the cosmetic material is covered, and an open position, in which the cosmetic material is uncovered. The cover can be releasably retained in its open and closed positions by lips and/or lugs molded monolithically with or otherwise provided on the core of the compact case, thereby eliminating the need to equip the compact case with clasps, catches or the like.

BRIEF DESCRIPTION OF THE DRAWINGS

For a better understanding of the present invention, reference is made to the following detailed description of various exemplary embodiments considered in conjunction with the accompanying drawings, in which:

FIG. 4 is a cross-sectional view, similar to that of FIG. 3, of a cosmetic compact case constructed in accordance with another exemplary embodiment of the present invention;

FIG. 5 is a cross-sectional view, similar to that of FIG. 3, of a cosmetic compact case constructed in accordance with another exemplary embodiment of the present invention;

FIG. 6 is a cross-sectional view, similar to that of FIG. 3, of a cosmetic compact case constructed in accordance with yet another exemplary embodiment of the present invention; and FIG. 7 is a cross-sectional view, similar to that of FIG. 3, of a cosmetic compact case constructed in accordance with still another exemplary embodiment of the present invention.

DETAILED DESCRIPTION OF THE EXEMPLARY EMBODIMENTS

Figure 1:
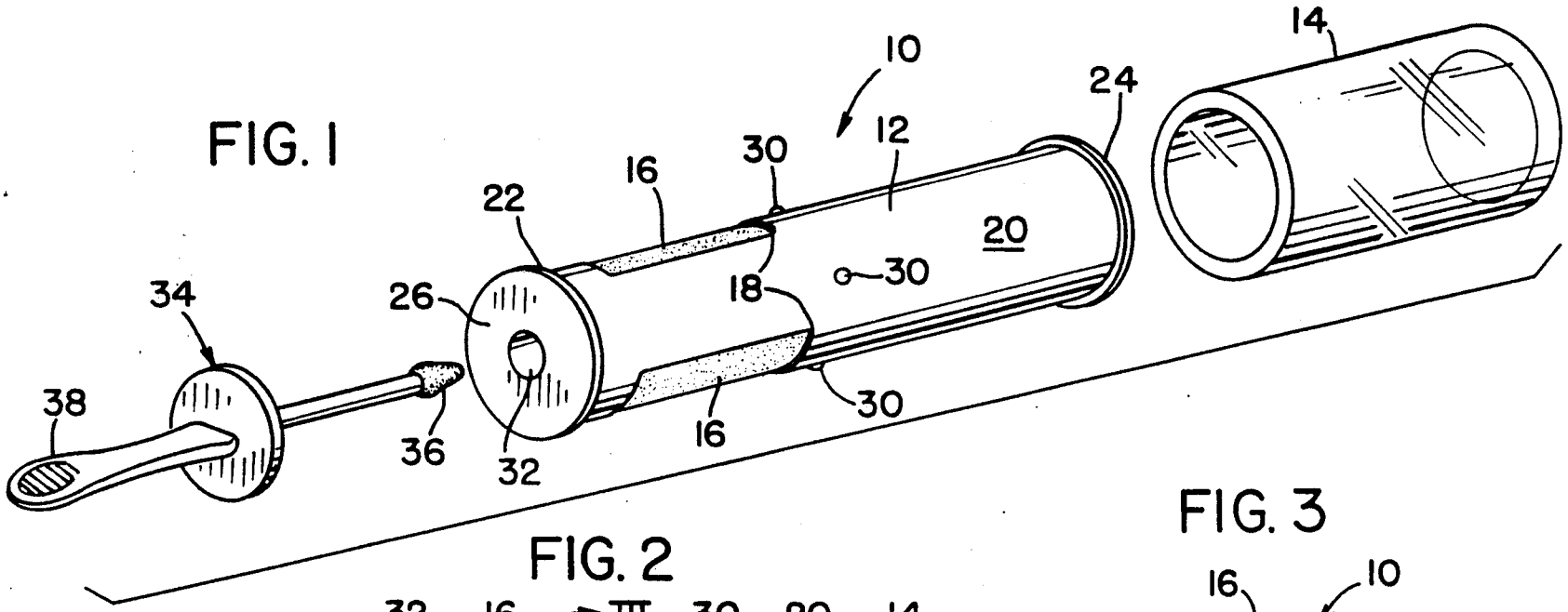
FIG. 1 is an exploded perspective view of a cosmetic compact case constructed in accordance with one exemplary embodiment of the present invention.
Figure 3:
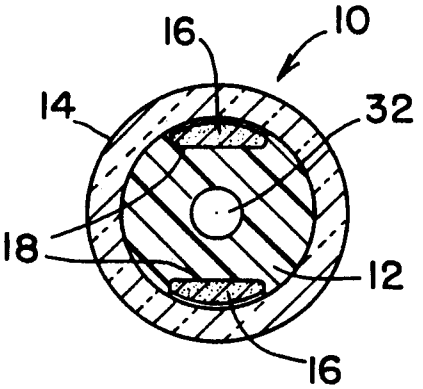
FIG. 3 is a cross-sectional view, taken along section III—III in FIG. 2 and looking in the direction of the arrows, of the compact case illustrated in FIG. 2.
Figure 2:
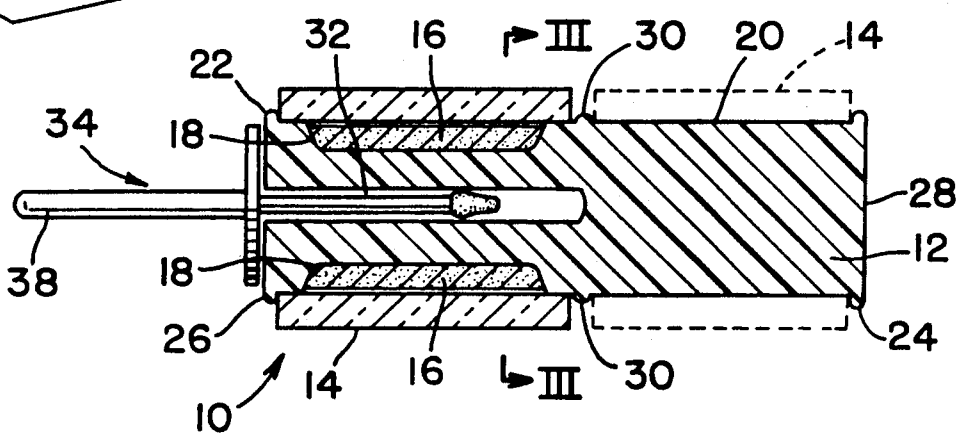
FIG. 2 is a longitudinal cross-sectional view of the compact case illustrated in FIG. 1.

Referring to FIGS. 1-3, there is shown a compact case 10 having a core 12 upon which is slideably received a concentric, transparent sheath 14 for selectively covering and uncovering cosmetic material 16 deposited in depressions 18 formed in an outer circumferential surface 20 of the core 12. In the preferred embodiment shown, the sheath 14 is in the form of a complete sleeve (i.e., it is circumferentially continuous). The sheath 14 does not, however, have to be a complete sleeve and could instead be C-shaped, so long as it tends to embrace the core 12.

The sleeve 14 is retained on the core 12 and restrained to a limited range of motion parallel to the longitudinal axis of the core 12 by a front retainer lip 22 and a rear retainer lip 24, which can be formed by flaring opposite ends 26 and 28 of the core 12 using a heat source to soften them while urging them into a suitable die, or by gluing or merging separately manufactured retainer rings onto the ends 26 and 28 of the core 12. A plurality of lugs 30 project outwardly from a central region of the outer circumferential surface 20 of the core 12 for a purpose to be described hereinafter.

An opening 32 is provided in the end 26 of the core 12. The opening 32 is sized and shaped so as to removably receive a cosmetic applicator 34 which can be, for instance, frictionally or threadedly retained within the opening 32. The applicator 34 has a conventional sponge or foam tip 36 adapted to pick up and dispense the cosmetic material 16. The applicator 34 also has a handle 38 which extends outwardly from the end 26 of the core 12 when the applicator 34 is fully inserted into the opening 32.

With particular reference to FIG. 2, when the sheath 14 is in a closed position (i.e., as indicated by solid lines in FIG. 2), it covers the depressions 18 and hence the cosmetic material 16 contained therein, the sheath 16 being maintained in such position by the retainer lip 22 and the lugs 30. By providing a friction fit or a sliding fit between the core 12 and the sheath 14, the cosmetic material 16 is isolated or sealed off from the outside environment when the sheath 14 is in its closed position, thereby inhibiting contamination, spoilage and/or spillage of the cosmetic material 16.

While the retainer lips 22 and 24 would normally be sized and shaped so as to prevent the inadvertent removal of the sheath 14 from the core 12, the lugs 30 are sized and shaped so as to offer only slight resistance to the movement of the sheath 14 relative to the core 12. Thus, the sheath 14 can be moved from its closed position (indicated by solid lines in FIG. 2) to a closed position (illustrated in phantom in FIG. 2), in which it is positioned between the retainer lip 24 and the lugs 30.

In use, the sheath 14 would be slid relative to the core 12 from its closed position to its open position, thereby exposing the cosmetic material 16 contained in the depressions 18. Either before or after the cosmetic material 16 is exposed, the applicator 34 would be removed from the opening 32 in the end 26 of the core 12. The applicator 34 could then be used to pick up the exposed cosmetic material 16 and apply it to a user. When the user is finished, the applicator 34 would be returned to the opening 32 in the end 26 of the core 12, while the sheath 14 would be moved from its open position to its closed position, thereby covering the cosmetic material 16 and preventing access thereto.

Four other exemplary embodiments of the present invention are illustrated in FIGS. 4–7, respectively. The various elements illustrated in FIGS. 4–7 which correspond to elements described above with respect to the embodiment illustrated in FIGS. 1–3 are designated by corresponding reference numerals increased by one hundred, two hundred, three hundred and four hundred, respectively. Unless otherwise stated, the embodiments of FIGS. 4–7 operate in the same manner as the embodiment of FIGS. 1–3.

With reference to FIG. 4, a core 112 of a compact case 110 has a rectangular cross-sectional shape, which matches the rectangular cross-sectional shape of a transparent sheath 114. Depressions 118 in each face of the core 112 receive cosmetic material 116.

Referring now to FIG. 5, a core 212 of a compact case 210 has a hexagonal cross-sectional shape, which matches the hexagonal cross-sectional shape of a transparent sheath 214. Depressions 218 in each face of the core 212 receive cosmetic material 216.

With reference to FIG. 6, a core 312 of a compact case 310 has a triangular cross-sectional shape, which matches the triangular cross-sectional shape of a transparent sheath 314. Depressions 318 in each face of the core 312 receive cosmetic material 316.

Referring finally to FIG. 7, a core 412 of a compact case 410 has, like the one employed by the embodiment of FIGS. 1–3, a circular cross-sectional shape. A transparent sheath 414 has, like the one employed by the embodiment of FIGS. 1–3, a matching circular cross-sectional shape. However, unlike the one employed by the embodiment of FIGS. 1–3, the sheath 414 is formed from a pair of substantially identical half sleeves 415 mounted for movement independently of each other so that depressions 418 containing cosmetic material 416 can be accessed selectively and individually.

It will be understood that the embodiments described herein are merely exemplary and that a person skilled in the art may make many variations and modifications without departing from the spirit and scope of the invention. All such variations and modifications are intended to be included within the scope of the invention as defined in the appended claims.

We claim:

1. A cosmetic compact case, comprising an elongated core having an outer circumferential surface and a central longitudinal axis extending between opposite ends of said core; a plurality of receiving means provided on said outer circumferential surface of said core, each of said receiving means being sized and shaped so as to receive a quantity of cosmetic material, and at least one of said receiving means being located on a first side of said core opposite from a second side which contains at least another one of said receiving means; covering means non-removably mounted on said core and axially slideable along said core in a direction generally parallel to said central longitudinal axis thereof, said covering means circumscribing said outer circumferential surface of said core and being movable between a closed position, in which said covering means is proximate to one of said ends of said core and in which all of said receiving means are covered to thereby preclude access to said cosmetic material contained therein, and an open position, in which said covering means is proximate to the other of said ends of said core and in which at least one of said receiving means is at least partially uncovered to thereby permit access to said cosmetic material contained therein; and storing means for removably storing an applicator for said cosmetic material, said storing means including an opening provided in said one end of said core, said opening extending internally of said core along said central longitudinal axis thereof.

2. A cosmetic compact case according to claim 1, wherein all of said receiving means are uncovered when said covering means is in its said open position.

3. A cosmetic compact case according to claim 1, wherein said covering means includes a first cover member which covers at least one of said receiving means when said covering means is in its said closed position and which at least partially uncovers said at least one receiving means when said covering means is in its said open position, and a second cover member which covers the other of said receiving means when said covering means is in its said closed position and which at least partially uncovers said other of said receiving means when said covering means is in its said open position, said first and second cover members being slideably mounted on said core for reciprocating movement independently of each other.

4. A cosmetic compact case according to claim 1, wherein said core has a lateral cross-sectional shape which is generally polygonal, whereby said core has a plurality of faces, and wherein said covering means is a sleeve having a lateral cross-sectional shape which substantially matches that of said core.

5. A cosmetic compact case according to claim 4, wherein each of said faces of said core includes at least one of said receiving means.

6. A cosmetic compact case according to claim 1, further comprising retaining means for releasably retaining said covering means in its said closed position and its said open position.

7. A cosmetic compact case according to claim 6, wherein said retaining means includes a first lip projecting outwardly from said outer circumferential surface of said core adjacent said one end thereof, a second lip projecting outwardly from said outer circumferential surface of said core adjacent said other end thereof, and a plurality of lugs projecting outwardly from said outer circumferential surface of said core intermediate said one end thereof and said other end thereof, said lugs cooperating with said first lip to releasably retain said covering means in its said closed position and said lugs cooperating with said second lip to releasably retain said covering means in its said open position.

8. A cosmetic compact case according to claim 1, wherein said covering means engages said outer circumferential surface of said core around all of said receiving means to thereby isolate all of said receiving means from the outside environment, whereby the contamination, spoilage and/or spillage of cosmetic material received within said receiving means are inhibited.

9. A cosmetic compact case according to claim 1, wherein said covering means is transparent.

10. A cosmetic compact case, comprising an elongated core having an outer circumferential surface and a central longitudinal axis extending between opposite ends of said core; a plurality of receiving means provided on said outer circumferential surface of said core, each of said receiving means being sized and shaped so as to receive a quantity of cosmetic material, and at least one of said receiving means being located on a first side of said core opposite from a second side which contains at least another one of said receiving means; covering means axially slideable along said core in a direction generally parallel to said central longitudinal axis thereof, said covering means circumscribing said outer circumferential surface of said core and being movable between a closed position, in which said covering means is proximate to one of said ends of said core and in which all of said receiving means are covered to thereby preclude access to said cosmetic material contained therein, and an open position, in which said covering means is proximate to the other of said ends of said core and in which at least one of said receiving means is at least partially uncovered to thereby permit access to said cosmetic material contained therein; and retaining means for releasably retaining said covering means in its said closed position and its said open position, said retaining means including a first lip projecting outwardly from said outer circumferential surface of said core adjacent said one end thereof, a second lip projecting outwardly from said outer circumferential surface of said core adjacent said other end thereof, and a plurality of lugs projecting outwardly from said outer circumferential surface of said core intermediate said one end thereof and said other end thereof, said lugs cooperating with said first lip to releasably retain said covering means in its said closed position and said lugs cooperating with said second lip to releasably retain said covering means in its said open position.

11. A cosmetic compact case according to claim 1, wherein said core has a lateral cross-sectional shape which is generally circular, and wherein said covering means is a sleeve having a lateral cross-sectional shape which substantially matches that of said core.

* * * * *